United States Patent [19]

Nelson

[11] 4,190,978

[45] * Mar. 4, 1980

[54] COLLAPSIBLE PLAYHOUSE MADE OF TWO EQUAL PARTS

[76] Inventor: Donald C. Nelson, 312 Belmont Ave., Mt. Pocono, Pa. 18344

[ * ] Notice: The portion of the term of this patent subsequent to Aug. 31, 1993, has been disclaimed.

[21] Appl. No.: 868,309

[22] Filed: Jan. 10, 1978

Related U.S. Application Data

[63] Continuation of Ser. No. 800,002, May 24, 1977, abandoned.

[51] Int. Cl.[2] ..... A63H 33/00

[52] U.S. Cl. ..... 46/12

[58] Field of Search ..... 46/12, 13, 11, 21

[56] References Cited

U.S. PATENT DOCUMENTS

| | | | |
|---|---|---|---|
| 1,867,374 | 7/1932 | Myers | 46/21 |
| 2,083,597 | 6/1937 | Edelman | 46/11 |
| 3,456,380 | 7/1969 | Cameron | 46/12 |
| 3,719,001 | 3/1973 | Archer | 46/21 X |

FOREIGN PATENT DOCUMENTS

| | | | |
|---|---|---|---|
| 289615 | 5/1928 | United Kingdom | 46/21 |
| 588518 | 5/1947 | United Kingdom | 46/21 |

*Primary Examiner*—F. Barry Shay

[57] ABSTRACT

A collapsible playhouse made from two halves of sheet material, such as corrugated cardboard, secured together. Material is applied at the edges to make them smooth and prevent cuts from being inflicted on the user. The applied material also strengthens the edge areas. It may be provided in the form of tape, or of tabs extended from the free edges to be folded back therefrom. The edges could be compressed to the normal sheet thickness by running the material through a roller press.

1 Claim, 4 Drawing Figures

COLLAPSIBLE PLAYHOUSE MADE OF TWO EQUAL PARTS

This application is a continuation of application Ser. No. 800,002, filed May 24, 1977, now abandoned.

This invention relates to certain improvements in U.S. Pat. No. 3,977,119, a COLLAPSIBLE PLAYHOUSE MADE OF TWO EQUAL PARTS. These improvements add safety and strengthen and improve the appearance of the invention which will be more fully pointed out in the claims at the end of the specification.

Figure 1:
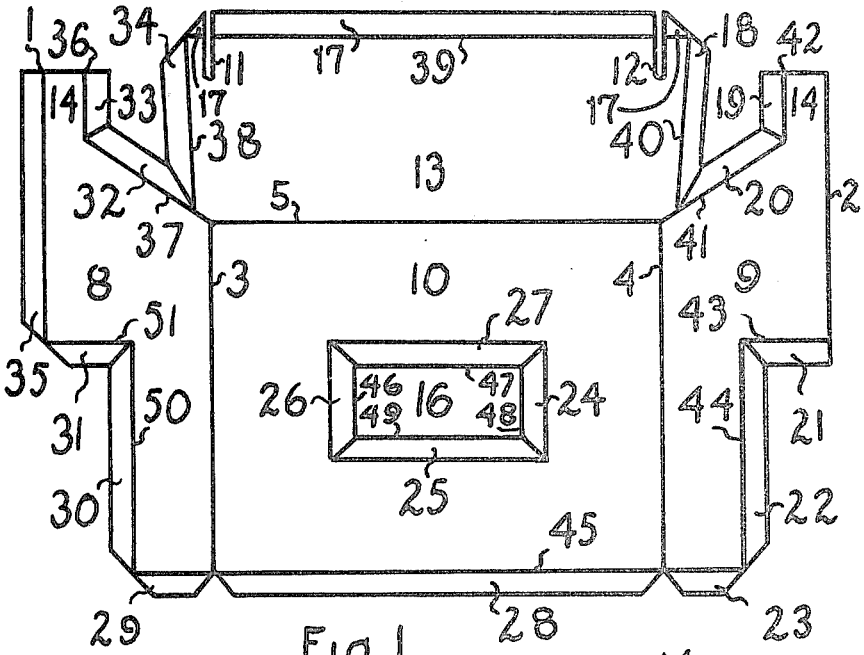

FIG. 1 is an alternate plan view of the pattern shown in U.S. Pat. 3,977,119 which conists of one half of the playhouse. The changes or additions in the alternate pattern are as follows;

1A. If the doors are not desired, the opening can be moved so that one half of the opening is at each end of the pattern. This arrangement would result in a stronger corner.

1B. A tab 35, of sufficient size, could be added to end 8 and would act as a hinge when the patterns are assembled to form a complete playhouse. This is accomplished by using an adhesive or other accepted methods to attach tab 35 to the back side of end 9 along line 2.

1C. Since some materials, such as certain corrugated cardboards, can have rough or sharp edges when cut it might be desirable to add or apply some material to the rough or sharp edges to prevent cuts, or tabs such as 17 through 34 could be added to the pattern, folded 180 degrees and affixed to the back side of the pattern by any acceptable method to assure smooth edges around the window and door openings. It would also strengthen those areas, as well as along the free edge roof line and the roof ends outside of the slots 11 and 12. The tabs would be folded to the back side of the pattern in the following manner; Tabs 17 would be folded along line 39. Tab 18 along line 40. Tab 19 along line 42. Tab 20 along line 41. Tab 21 along line 43. Tab 22 along line 44. Tabs 23, 28 and 29 along line 45. Tab 24 along line 48. Tab 25 along line 49. Tab 26 along line 46. Tab 27 along line 47. Tab 30 along line 50. Tab 31 along line 51. Tab 32 along line 37. Tab 33 along line 36. Tab 34 along line 38. The tabs could be compressed by running the pattern through a roller or press so that all parts of the pattern would be of the same thickness to assure that it would fold properly for storage.

1D. End roof lines 38 and 40 could be moved out so they start along lines 37 and 41 instead of at the point where lines 37,38,5,3 and lines 40,41,4,5 meet. This arrangement would make a stronger roof from the slots 11 and 12 outward to the end roof edge. It would also improve the appearance of the playhouse.

All other features are the same as shown in U.S. Pat. No. 3,977,119.

Figure 2:
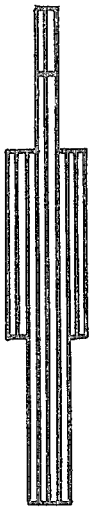

FIG. 2. shows an end view of the playhouse completely folded for storage with reinforcing material around roof edges.

Figure 3:
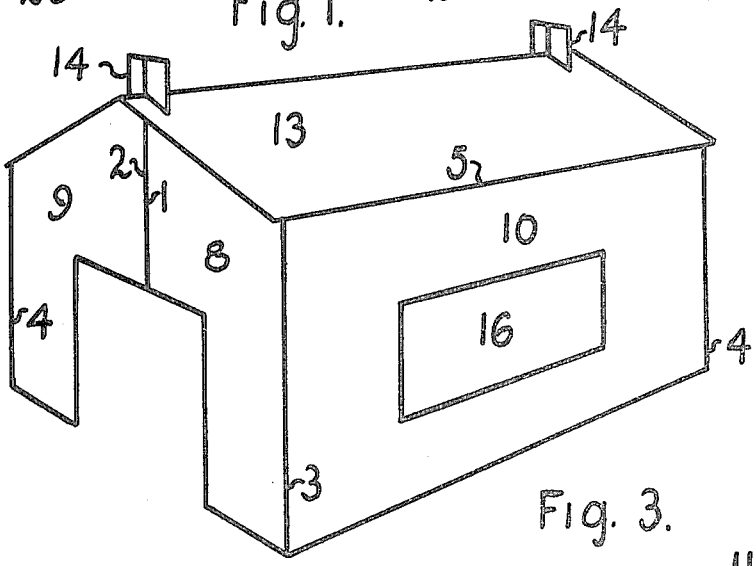

FIG. 3. shows a perspective view of the playhouse in a fully erected position.

Figure 4:
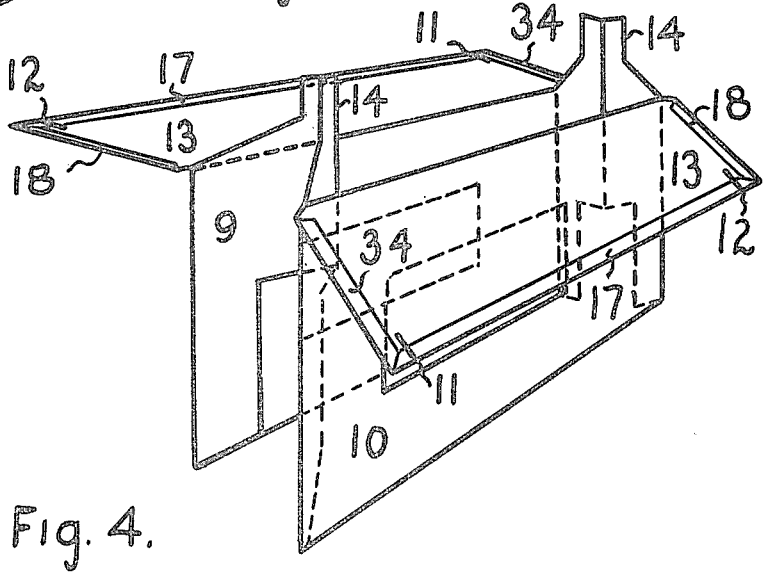

FIG. 4. shows the playhouse in a partially folded position.

All parts are identified by their numerals of reference which are the same in each of the views.

The playhouse, depending on the material used and the method of manufacture, can be made of one, two or more pieces of material which when properly cut, folded and connected together would form a complete playhouse of equal halves. Generally made of two pieces, they would be affixed along line 1–2 to form a complete playhouse. If tabs 17 through 34 are added to the pattern, they are folded 180 degrees and affixed to the back side of the pattern. Scored lines 3 and 4 are folded 90 degrees to form one half the end walls marked 8 and 9 plus one side wall marked 10. Scored line 5 is folded inward until the slots 11 and 12 in half roof 13 fit around the chimney 14 to form a rigid structure. The door opening can be of any convenient size. The window opening 16 can also be of any convenient size or more than one window may be provided.

As can be seen in FIG. 1. side wall 10 is generally a rectangle bounded by parallel fold lines 3,4 and fold line 5, perpendicular to lines 3 and 4. The half end walls have parallel vertical sides and upwardly inclined upper edges. The half roof has a free edge longer than fold line 5 and arranged so that slots 11,12 near the free edge ends can receive projections 14 as shown in FIG. 3.

Referring now to FIG. 1. The collapsible playhouse constructed according to my invention consists of, when made of cardboard or similar material, one, two or more pieces which when properly folded and taped or hinged form a complete playhouse. If materials used make scoring impractical, all scored areas can be cut through and hinged instead so the playhouse can be folded flat for easy storage as shown in FIG. 2.

I claim as my invention:

1. A simple collapsible playhouse:

made of two equal parts, each said part comprising one rectangular side wall, two half end walls connected by fold lines at respective ends of said side wall and a half roof connected by a fold line to the upper longitudinal edge of said sidewall, each said half end wall having a bottom edge perpendicular to its associated fold line, an end edge substantially parallel to but longer than said associated fold line and a straight upper edge portion inclined upwardly from said associated fold line, said upper edge portion terminating in a short rectangular projection parallel to said end edge, said half roof having a free edge parallel to and longer than its associated fold line, and having a slot at each end extending perpendicularly to said free edge, each said part having means at at least some of the free edges for finishing the edges to protect the user against cuts and the like; means permanently connecting both the end edges of said half end walls to one another so that the playhouse may be moved from a collapsed position, wherein the end walls are folded between the side walls, to an erected position wherein the end walls are perpendicular to said side walls and said half roofs overlie said end wall upper edges with the projections on said end walls received in said slots.

* * * * *